United States Patent [19]

Bahnmüller et al.

[11] Patent Number: 5,045,444

[45] Date of Patent: Sep. 3, 1991

[54] PHOTOGRAPHIC RECORDING MATERIAL WITH CONTINUOUS TONE GRADATION SUITABLE FOR PROCESSING IN DAYLIGHT

[75] Inventors: Wilfried Bahnmüller, Geretsried/Gelting; Jutta Finkener; Dieter Himmelreich, both of Munich; Wolfgang Reiber, Gauting; Heinz Schwarz, Munich, all of Fed. Rep. of Germany

[73] Assignee: Agfa Gevaert Aktiengesellschaft, Leverkusen, Fed. Rep. of Germany

[21] Appl. No.: 640,524

[22] Filed: Jan. 11, 1991

Related U.S. Application Data

[63] Continuation of Ser. No. 383,200, Jul. 20, 1989, abandoned.

[30] Foreign Application Priority Data

Aug. 3, 1988 [DE] Fed. Rep. of Germany ..... 3826374

[51] Int. Cl.[5] ..... G03C 1/02; G03C 1/36

[52] U.S. Cl. ..... 430/567; 430/569; 430/606

[58] Field of Search ..... 430/264, 567, 569, 570, 430/606, 611, 613

[56] References Cited

U.S. PATENT DOCUMENTS

| | | | |
|---|---|---|---|
| 4,818,659 | 4/1989 | Takahashi et al. | 430/265 |
| 4,828,972 | 5/1989 | Ihama et al. | 430/570 |
| 4,830,950 | 5/1989 | Kuwakara et al. | 430/606 |
| 4,892,812 | 1/1990 | Kohnura et al. | 430/611 |

FOREIGN PATENT DOCUMENTS

| | | |
|---|---|---|
| 0256781 | 2/1988 | European Pat. Off. . |
| 3403825 | 8/1984 | Fed. Rep. of Germany . |

*Primary Examiner*—Hoa Van Le

*Attorney, Agent, or Firm*—Connolly & Hutz

[57] ABSTRACT

Black-and-white continuous tone reproductions may be obtained under daylight conditions with a photographic recording material in which the silver halide consists to an extent of at least 75 mol % of silver chloride and has been prepared in the presence of a 1-phenyl-5-mercaptotetrazole compound. The material is particularly suitable for reprophotographic work, e.g. for the production of continuously graduated masks.

8 Claims, No Drawings

PHOTOGRAPHIC RECORDING MATERIAL WITH CONTINUOUS TONE GRADATION SUITABLE FOR PROCESSING IN DAYLIGHT

This application is a continuation of application Ser. No. 07/383,200 filed July 20, 1989, now abandoned.

This invention relates to a photographic recording material which can be processed in daylight (daylight film) suitable for the reproduction of continuous tones. A daylight film is a film which can be handled in daylight or under daylight conditions, in particular exposed image-wise and developed. Such a film obviously has a comparatively low sensitivity.

It is known that as the sensitivity of silver halide emulsions decreases from the highly sensitive to the relatively insensitive, the gradation curve obtained on development becomes progressively steeper until a certain limiting gradation is obtained which cannot be exceeded without additional measures. This gradation, however, is so steep that the reproductions obtained are virtually only black-and-white without any grey tones.

Films of this type have long been used in the graphics industry. In recent years, it has become possible to produce films which are so insensitive that they can be handled in ordinary daylight or under strip lighting without recourse to a dark chamber. As already mentioned, however, all materials of this type available on the market have such a steep gradation that grey tones cannot be reproduced. There is a demand for recording material which can be processed under daylight conditions but has such a flat gradation that grey tones can be reproduced. This would be a great advantage, especially for the production of continuously graduated masks.

If in the present state of the art a reprophotographer using daylight systems wishes to produce such a continuously graduated mask, he is confronted with the problem that only relatively sensitive films which are not daylight-proof are available for this purpose. He must therefore leave his workplace to take the mask into a dark chamber to expose it there on a conventional continuous tone film and then develop it in a development machine also housed in the dark chamber. This entails considerable additional expenditure of time and money (material and investment costs). A process which would obviate the use of a dark chamber and of a separate development machine would have great advantages.

It is known and state of the art to inhibit the grain growth in the preparation of silver halide emulsions by carrying out the precipitation of the silver halide in the presence of compounds which are strongly adsorbed on silver halide. Various stabilizers for this purpose have been described in the literature, in particular amino acids and other organic compounds containing nitrogen and/or sulphur. One compound frequently used for such purposes is phenyl mercaptotetrazole, see GB 1 204 623. Such procedures are normally only carried out with silver halide emulsions which consist mainly of silver bromide, optionally with small proportions of silver chloride and/or silver iodide, since the great advantage of silver chloride of being capable of rapid development is not important in such fine grained emulsions.

When attempts are made to inhibit the grain growth in silver chloride-rich emulsions by means of a stabilizer of the phenyl mercaptotetrazole series, it is surprisingly found that the gradation of the resulting emulsions is very much flatter than expected and can be adjusted according to the quantity of growth inhibitor used. This takes place without any conspicuous increase in the range of the grain size distribution of the emulsion. This is a completely surprising and unexpected effect. A flat gradation is normally produced by a very wide grain size distribution of the silver halide, which corresponds to a wide sensitivity distribution of the grains.

This invention relates to a photographic recording material which can be processed in daylight, in particular a daylight film having at least one silver halide emulsion layer applied to a layer support, characterised in that the silver halide consists to an extent of at least 75 mol % of silver chloride, preferably at least 95 mol %, and has been prepared in the presence of a 1-phenyl-5-mercaptotetrazole.

The 1-phenyl-5-mercaptotetrazole compound may be 1-phenyl-5-mercaptotetrazole itself but may also be substituted on the phenyl ring, e.g. with amino, acylamino or solubilizing functional groups such as hydroxyl or carboxyl. The 1-phenyl-5-mercaptotetrazole compound may be in a form in which the mercapto group is blocked and is optionally only released under the conditions of precipitation. 1-Phenyl-5-mercaptotetrazole compounds containing a blocked mercapto group are described, for example, in DE-A-21 61 044 and DE-A-21 61 045.

The 1-phenyl-5-mercaptotetrazole compound is preferably used in a quantity of from 0.5 to 50 mmol, based on 1 mol of all the silver nitrate used for the precipitation of the silver halide.

For the process of precipitation, the 1-phenyl-5-mercaptotetrazole compound is introduced into the reaction vessel in the form of a solution together with an emulsion binder, in particular gelatine, and the partners for the precipitation reaction, i.e. silver nitrate solution and halide solution, are generally added by the double jet process. The composition of the halide solution substantially corresponds to the proportion of halide required in the emulsion. The halide of the halide solution therefore consists mainly of chloride, i.e. to an extent of more than 75 mol-% preferably more than 95 mol-%, and the remainder consists of bromide and/or iodide, the iodide content being generally not greater than 10 mol %. If desired, part or all of the iodide may be added after completion of the precipitation process proper. Bromide and iodide may be completely omitted when a pure silver chloride emulsion is to be prepared. The silver chloride emulsions of the present invention normally have an average grain size of less than 0.1 μm. They may be homodisperse or heterodisperse emulsions, for example an emulsion, wherein 90 percent of all grains have a grain size which is greater or smaller than the average grain size by 0.04 μm or less.

The emulsions may be worked up by the usual methods, e.g. by flocculation, washing and redispersion. The emulsions are not chemically ripened but may be mixed with the usual additives, in particular other stabilizers such as mercury salts, triazaindolizines, wetting agents and hardeners. Spectral sensitizers may even be added without thereby significantly altering the insensitivity to daylight. Electron acceptors such as pinacryptol yellow and similar compounds may advantageously be added as desensitizers for further suppressing the sensitivity to daylight.

Noble metal compounds such as hexahalogen complexes of rhodium, iridium or osmium may also advantageously be added.

In a preferred embodiment, the silver halide emulsion according to the invention may contain, for example, from 10 to 200 mg of pinacryptol yellow and/or from 1 to 100 mg of sodium hexachlororhodiate-III per mol of silver.

The emulsion according to the invention may be cast as a single layer or it may be divided up into two or more layers cast directly one upon the other or separated by separating layers. For obtaining special forms of density curves, a multilayered film may be prepared in which one or more layers consist of a high contrast emulsion and one or more layers of the continuous tone dayliqht emulsion described. One could even conceivably combine the half-tone daylight emulsions according to the invention with conventional emulsions for producing special effects. A protective layer is normally placed above the layer containing the emulsion according to the invention and another layer free from silver may be situated between the protective layer and the substrate layer of the layer support. Further, a silver halide emulsion with normal steep gradation may be combined with a layer of the emulsion according to the invention, which may have the same or a different spectral sensitization. All the layers may contain so-called screening dyes which are not photographically active and only absorb light and therefore contribute to the sharpness.

The emulsions may be cast on transparent supports, e.g. a transparent film or a glass plate, but opaque support may also be used, e.g. layer supports of paper, optionally coated on one or both sides to render it hydrophobic.

The emulsion layer may contain developer substances to simplify development but the developer substances may also be incorporated in separate layers above, below or between the emulsion layer or layers.

The daylight film according to the invention is eminently suitable for the production of black-and-white continuous tone reproductions, in particular for the production of continuously graduated masks which may occasionally be combined with colour separation reproductions in reprophotography. By virtue of its property of being suitable for being processed in daylight or under daylight conditions, e.g. under strip lighting, the daylight film according to the invention constitutes a valuable contribution to reprophotography since it dispenses with the need for dark chamber equipment.

EXAMPLE 1

Emulsion formulation

| | | | |
|---|---|---|---|
| A: | 3500 ml | of water | 25° C. |
| | 1225 g | of $AgNO_3$ | |
| B: | 3000 ml | of water | 25° C. |
| | 172 g | of KBr | |
| | 375 g | of NaCl | |
| C: | 5600 ml | of water | 40° C. |
| | 172 g | of inert gelatine | |

phenylmercaptotetrazole (as indicated in Table 1) dissolved in 350 ml of methanol Solutions A and B are both introduced into Solution C by the double jet process in 120 seconds without pAg control. After termination of the double jet process, a solution of 12 g of KI in 100 ml of water is added and the reaction mixture is stirred for 4 minutes and then flocculated with polystyrene sulphonic acid in the usual manner and washed.

The emulsions are not chemically ripened. The following are added before casting, the quantities being based on 45 g of $AgNO_3$:

| | |
|---|---|
| 32 mg | of pinacryptol yellow (dissolved in water) |
| 0.68 mg | of sodium hexachlororhodiate-III |
| 32 mg | of compound of Formula I |
| 3200 mg | of compound of Formula II. |

Wetting agent is added according to the casting system used.

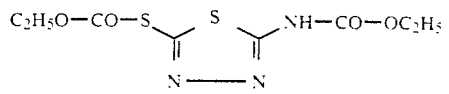

I

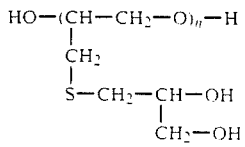

II

The emulsion is used to form a coating applied in a quantity corresponding to 3.0 g of silver nitrate per $m^2$. A protective layer consisting of a 3.2% aqueous gelatine solution containing wetting agent suitable for the casting system and 0.2% of formaldehyde as hardener is drawn over the emulsion layer.

The thickness of the protective layer after drying is about 1 μm.

After casting, the material is stored until hardening has increased to a constant value. To test the material, it is exposed behind a stepped wedge in a conventional daylight copying apparatus. It is then developed for varying lengths of time at 27° C. in a phenidone-hydroquinone developer having the following composition:

| | |
|---|---|
| 2 g | of Trilon B |
| 70 g | of $K_2CO_3$ |
| 200 g | of $K_2SO_3$ |
| 30 g | of KBr |
| 16 g | of KOH |
| 60 g | of hydroquinone |
| 1.45 g | of phenidone |
| 90 mg | of 1-phenyl-5-mercaptotetrazole. |

made up to 1000 ml with water (concentrate).

1 Part by volume of the concentrate is diluted with 2 parts by volume of water before use.

TABLE 1

| Quantity of phenylmercaptotetrazole [g] | Gradation measured over the range of densities of from 0.3 to 1.7 after a development time of: | | |
|---|---|---|---|
| | 164 s | 82 s | 32 s |
| 0 | 2.98 | 2.77 | 2.69 |
| 6.5 | 1.57 | 1.45 | 1.27 |
| 13.0 | 1.45 | 1.25 | 1.06 |
| 26.0 | 0.78 | 0.76 | 0.74 |

EXAMPLE 2

An emulsion is prepared as described in Example 1 but only 17.2 g of KBr are used instead of 172 g of KBr and 451 g of NaCl are used instead of 375 g of NaCl.

TABLE 2

| Quantity of phenylmercapto-tetrazole [g] | Gradation determined over the range of densities of from 0.3 to 1.7 after a development time of: | | |
|---|---|---|---|
| | 164 s | 82 s | 32 s |
| 0 | 3.14 | 3.01 | 3.20 |
| 26.0 | 1.03 | 0.99 | 0.98 |

We claim:

1. Photographic recording material for the production of black-and-white continuous tone reproductions suitable for processing in daylight, containing at least one silver halide emulsion layer applied to a transparent layer support, characterised in that the silver halide consists to an extent of at least 75 mol-% of silver chloride, has an average grain size of less than 0.1 μm and has been prepared in the presence of from 0.5 to 50 mmol of a 1-phenyl-5-mercaptotetrazole compound based on one mol of the total silver nitrate to be used for the precipitation.

2. Recording material according to claim 1, characterised in that the silver halide emulsion is not chemically ripened.

3. Recording material according to claim 1, characterised in that the silver halide emulsion contains from 0 to 25 mol-% of silver bromide and/or from 0 to 10 mol-% of silver iodide.

4. Recording material according to claim 1, characterised in that the silver halide emulsion contains from 10 to 200 mg of pinacryptol yellow per mol of silver.

5. Recording material according to claim 1, characterised in that the silver halide emulsion contains from 1 to 100 mg of sodium hexachlororhodiate-III per mol of silver.

6. Recording material according to claim 1, characterised in that the silver halide emulsion contains 10 to 250 mg of a spectral sensitizer per mol of silver halide.

7. Recording material according to claim 4, characterised in that the silver emulsion contains from 1 to 100 mg of sodium hexachlororhodiate-III per mol of silver.

8. A method of preparing a photographic recording material for the production of black-and-white continuous tone reproductions suitable for processing in daylight which comprises the step of precipitating from a silver salt a silver halide emulsion comprising a silver halide consisting of at least 75 mol percent of silver chloride having an average grain size of less than 0.1 μm.

wherein the precipitation is carried out in the presence of from 0.5 to 50 m mol of a 1-phenyl-5-mercaptotetrazole compound, based on one mol of the silver salt.

* * * * *